United States Patent [19]

Jacobsson

[11] Patent Number: 4,522,305

[45] Date of Patent: Jun. 11, 1985

[54] OPENING ARRANGEMENT FOR PACKING CONTAINERS WITH PRESSURIZED CONTENTS

[75] Inventor: Kenth Jacobsson, Södra Sandby, Sweden

[73] Assignee: Tetra Pak Developpement SA, Pully, Switzerland

[21] Appl. No.: 410,714

[22] Filed: Aug. 23, 1982

[30] Foreign Application Priority Data

Aug. 28, 1981 [SE] Sweden ..... 8105092

[51] Int. Cl.[3] ..... B65D 37/00

[52] U.S. Cl. ..... 206/632; 383/111

[58] Field of Search ..... 206/632, 633, 605, 610, 206/615, 618, 631; 229/55, 7 R, 17 R; 220/359, 260, 270, 258, 269; 383/109, 111, 116, 113, 84

[56] References Cited

U.S. PATENT DOCUMENTS

| | | | |
|---|---|---|---|
| 2,970,737 | 2/1961 | Rice | 229/7 R |
| 3,166,226 | 1/1965 | Mobley | 229/7 R |
| 3,547,305 | 12/1970 | Khoury | 220/359 |
| 3,650,386 | 3/1972 | Tigner | 206/631 |
| 3,655,503 | 4/1972 | Stanley et al. | 206/631 X |
| 3,883,034 | 5/1975 | Rausing | 229/7 R |
| 3,977,562 | 8/1976 | Wedzik | 220/270 |
| 4,165,004 | 8/1979 | Bartels | 206/631 |
| 4,165,015 | 8/1979 | Hasegawa | 220/258 |
| 4,258,876 | 3/1981 | Ljungerantz | 229/7 R X |
| 4,280,653 | 7/1981 | Elias | 215/233 X |
| 4,367,842 | 1/1983 | Rausing | 229/7 R |

*Primary Examiner*—Allan N. Shoap
*Assistant Examiner*—Bryon Gehman
*Attorney, Agent, or Firm*—Burns, Doane, Swecker & Mathis

[57] ABSTRACT

Opening arrangements for packing containers which are manufactured from a flexible material and intended for pressurized contents, e.g. beer, are sometimes in the form of a tear-off cover strip which is sealed to the packing container wall and covers a pouring opening punched out in the same. In order to withstand the high internal pressure which is caused by the contents, the seal between the cover strip and the packing material must be strong, which detrimentally affects the openability of the packing container. By ensuring that the mutual bond between the different layers in the packing laminate is weaker than the seal between the cover strip and the outer layer of the container material, a readily opening packing container is provided, in spite of the seal between the cover strip and the packing laminate being of a strength such that the risk of leakage or unintentional opening is small. By sealing the cover strip in a zone extending around the pouring opening which zone is at some distance from the actual pouring opening and by providing the pouring opening with a "set in" pouring edge, the properties of the opening arrangement are optimized further without increasing the risk of leakage or making the handling more difficult.

1 Claim, 4 Drawing Figures

OPENING ARRANGEMENT FOR PACKING CONTAINERS WITH PRESSURIZED CONTENTS

BACKGROUND AND SUMMARY OF THE PRESENT INVENTION

The present invention relates generally to opening arrangements for packing containers. More specifically, the present invention relates to an opening arrangement for a packing container made of a multi-layer or laminated material and including a material strip applied over a pouring opening of the container which strip is sealed in a liquid-tight manner to the container material.

In non-returnable packages for pressurized contents, e.g. beer or carbonated beverages, the internal pressure in the package makes it difficult to design the package in such a manner that it is of sufficient strength and tightness, especially after prolonged storage in a warm environment. Special strength problems arise in the opening arrangement of the packing container, since it must present good strength and tightness while being openable without excessive effort. The opening arrangement frequently consists of a hole or a pouring opening punched out in the flexible packing material which is covered by a likewise flexible plastic strip which by heat-sealing forms a liquid-tight joint with the packing container material around the pouring opening (so-called pull-tab). The seal between the strip and the packing container material is achieved by fusing together the materials, which provides satisfactory strength and tightness, but as a result also renders appreciably more difficult the removal of the strip, so that the packing container cannot readily be opened.

Packing containers of the abovementioned type can be manufactured at present from flexible plastic laminate which comprises a number of layers of plastic material of different properties joined to one another. A typical material suitable for pressurized packing containers may consist e.g. of three layers of polyester joined together, the central polyester layer being biaxially oriented, so as to give the laminate good mechanical strength and low extensibility while the two outer layers are amorphous to allow sealing together of the packing container with the help of heat.

It is an object of the present invention to provide a packing container of this type with an opening arrangement which, by a good margin, resists the internal pressure in the packing container and which presents good tightness against liquid as well as gas. These and other objects have been achieved in accordance with the invention in that an opening arrangement of the type described in the introduction has been given the characteristic that the mutual bond between the material layers included in the container material is weaker than the seal between the strip and the container material. Owing to the aforementioned adaptation of the strength of seal between the strip and the packing laminate in relation to the strength of seal between the material layers included in the packing laminate it is possible to provide a strong bond between the strip and the packing laminate, so that the weld stands up well against the stresses caused by the internal pressure. These stresses make themselves felt largely as tensile stresses directed in the plane of the laminate (and of the strip). At the same time as the strong bond is provided, the forces occurring on opening of the packing container (largely directed at an angle of 90° to the plane of the packing container laminate) achieve relatively easily a delamination between the layers of the packing laminate so that not only the strip, but also a part of the outer, weaker layer of the laminate is entrained.

On opening of the packing container, cracks readily appear in the edge of the pouring opening at the moment when the tearing is initiated and the material starts to break, since the pouring edge at this moment is subjected to the combined effect of the tensile force in the strip and the pressure effect from the contents. In accordance with a preferred embodiment of the invention it has been possible to avoid these cracks by having the seal between the strip and the packing laminate extend around the pouring opening at a little distance outside this edge line. By virtue of this design the edge itself will be permanently in an unstressed and non-loaded condition, so that the cause of crack formation is effectively eliminated.

It is a further object of the present invention to provide a pouring edge formed in the packing laminate which is not deformed through stresses on storage or opening of the packing container and which does not disturb the tightness or the function of the opening arrangement.

These objects have been achieved in accordance with the invention, in that the pouring opening along a part of its periphery has a pouring edge which delimits a countersunk area situated close to the pouring opening. The pouring edge is thus situated wholly inside the plane which is defined by the outside of the laminate, so that it does not disturb the close contact of the strip against the outside of the laminate or in some other manner renders difficult the application or removal of the strip. Moreover, since the pouring edge is situated in the non-sealed area around the actual pouring opening, it is also not subjected to any one-sided pressure from the contents, so that it does not have to be dimensioned so as to permit any appreciable stress.

Further embodiments of the opening arrangement in accordance with the invention have been given the characteristics which are evident from the description below.

BRIEF DESCRIPTION OF THE DRAWINGS

A preferred embodiment of the opening arrangement in accordance with the invention will now be described in more detail with special reference to the attached, schematic drawings which for the sake of clarity only show the parts essential for an understanding of the invention.

DETAILED DESCRIPTION OF THE PREFERRED EMBODIMENT

Figure 1:
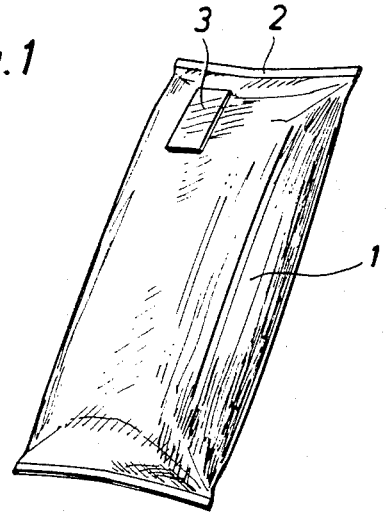
FIG. 1 is a perspective view of a substantially cushionlike packing container which is provided with an opening arrangement in accordance with the invention.

The opening arrangement in accordance with the invention is intended to be used on a packing container of the type which is made wholly or partly of a flexible plastic material and which e.g. may be cushionlike, as illustrated in FIG. 1. The packing container 1 is of elongated shape and has at its two short ends transverse seals 2 and an opening arrangement 3 in accordance with the invention, arranged near one of the transverse seals 2. The packing container is manufactured from a plastic laminate which includes three layers joined to one another, namely a centrally situated, biaxially oriented polyester layer which is covered on either side by amorphous, heat-weldable polyester layers.

Figure 2:
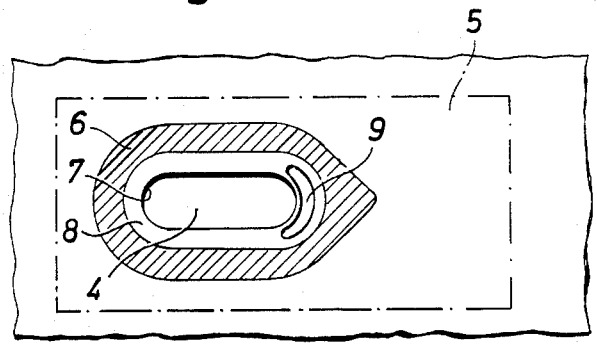
FIG. 2 is an enlarged plan view of an opening arrangement portion of FIG. 1 in accordance with the invention, a material strip covering the pouring opening being indicated by dash-dotted lines.
Figure 3:
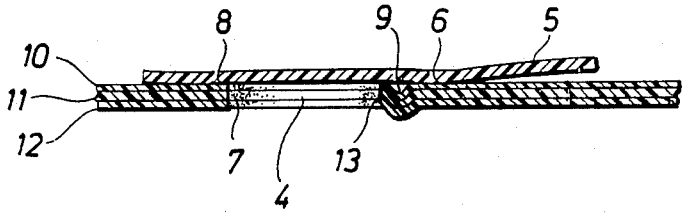
FIG. 3 is a cross-sectional view through a packing container wall with an opening arrangement according to FIG. 2 of the invention.

The openning arrangement 3 includes a pouring opening 4 (FIG. 2) punched through the packing laminate, which preferably is of a somewhat oval or elongated shape. The pouring opening 4 is covered by a material strip 5 which may consist of the same laminated plastic material as the packing container and which is sealed to the same in an area 6 extending around the pouring opening 4, shown hatched in FIG. 2. Between the sealing area 6 and the edge line 7 of the pouring opening 4 there is a non-sealed area 8 extending around the pouring opening 4. At the one end of the pouring opening 4 an arc-shaped recess 9 in the packing container material is provided in the area 8, which is clearly evident in FIG. 3 and which will be described in detail in the following. FIG. 3 also shows how the packing laminate is composed of three material layers 10, 11 and 12 joined to one another. The central layer 11 of the laminate is biaxially oriented and is adapted to absorb the forces which are caused by the pressure in the packing container, while the two outer amorphous material layers 10,12 make possible the heat-sealing at the two ends of the packing container and the heat-sealing between the cover strip 5 and the packing laminate. The cover strip 5, in order to be able to withstand the internal pressure in the package, must be just as strong as the laminate of the packing container and may e.g. have the same structure as the laminate, although for the sake of clarity this is not shown in FIG. 3.

In opening arrangements of the type including a punched hole with a covering strip, the seal between the strip and the packing laminate must be made very strong if the opening arrangement is to be able to withstand the high internal pressure which arises when the packing container is filled with pressurized liquid contents e.g. beer. This makes it very difficult to remove the cover strip when the packing container is to be opened, since the strong seal cannot easily be broken.

Figure 4:
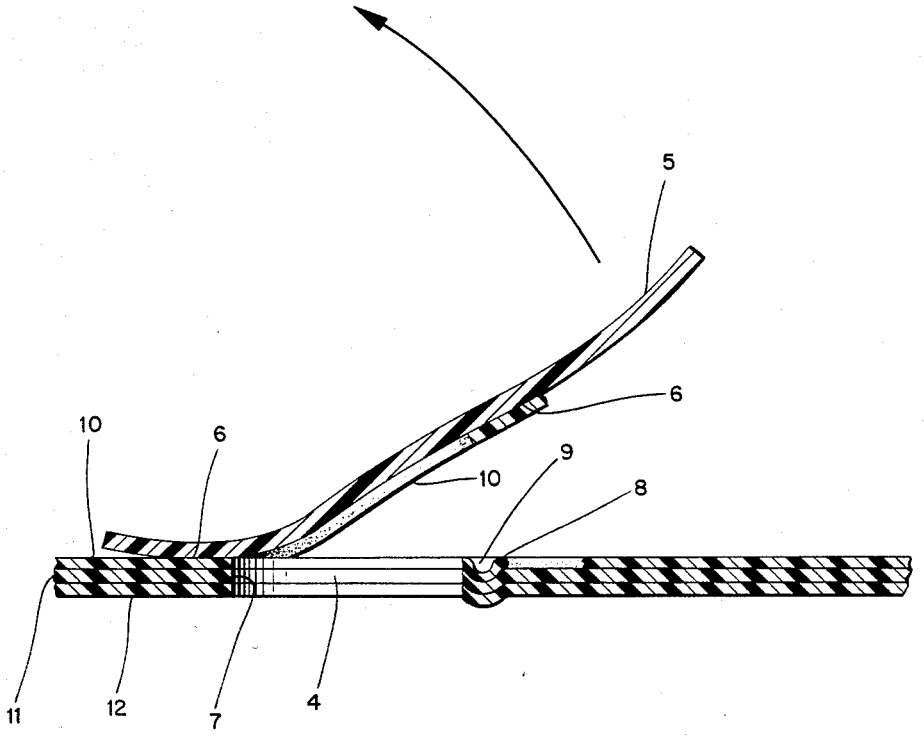
FIG. 4 is a cross-sectional view through the packing container wall after opening.

A combination of strong seal and readily openable packing container is provided in accordance with the invention, in that the seal between cover strip and packing laminate remains unbroken even when the cover strip is removed. This is possible because the cover strip, when it is torn off the packing container, causes a delamination in the packing laminate inasmuch as its outer layer 10, within an area substantially corresponding to the sealing zone 6, wholly or partly follows the cover strip 5, when the latter is removed. This is brought about by making the seal between the cover strip and the container material stronger than the mutual bond between the material layers included in the container material. Since the cover strip 5, or (in the case of laminated cover strip) the material layer of the cover strip facing towards the packing container, consists of the same amorphous material as the layer of the packing laminate facing towards it, the heat-sealing produces a complete welding together, which automatically will be stronger than the bond between the different layers of the packing laminate, since these, even if they consist of the same type of plastic (polyester), are not identical, but are oriented and amorphous respectively. The design does not increase the danger of leakage or unintentional opening, since the inner forces, which in closed position of the packing container act upon the cover strip, largely subject the seal 6 between the strip and the packing laminate, as well as the mutual seal between the different laminate layers, to tensile forces acting in the plane of the laminate. These tensile forces are not capable of separating the different layers. When the cover strip 5 is to be removed, its one non-sealed end is lifted and the cover strip is removed by pulling it at a substantially right angle to the plane of the packing laminate, as a result of which tensile forces, substantially perpendicular to the packing laminate, arise. Since the sealed area 6 between the projecting, non-sealed end of the tear-strip and the emptying opening is designed so as to form a point directed towards the non-sealed end, the tensile forces arising will be concentrated in a very limited area wherein a delamination between the layers 10 and 11 of the packing laminate can be readily initiated. The continued tensile force in the tear-strip 5 then directs the delamination around the emptying opening 4, until the cover strip has been completely separated from the packing container. This delamination of the packing laminate that occurs upon removal of the tear strip 5 is shown in FIG. 4.

As mentioned previously, the emptying opening 4 is punched out of the packing laminate during the manufacture of the packing container. The edges of the emptying opening in this case may have a large number of kerfs grooves or notches which may cause the packing laminate to rupture under the combined stresses which are produced by the internal pressure and the tension in the strip 5 during the opening stage. Practical tests have shown that this risk can be reduced and virtually eliminated, if the sealing zone 6 located around the pouring opening 4 is designed in such a manner that it does not extend right up to the edge line 7 of the pouring opening, that is to say if a non-sealed area 8 exists between the sealing zone 6 and the edge line 7. This design of the sealing zone 6 means that the forces arising through tension in the cover strip 5 do not directly affect the edge 7 of the pouring opening 4 and, consequently, also do not cause such stresses that a risk of crack formation in the edge would occur.

During emptying of the contents through a pouring opening punched in a plane or curved package surface, especially from a wholly filled package, it happens frequently that the jet of contents tends to follow wholly or partly the outside of the packing container, which renders more difficult the pouring out of the contents e.g. into a glass. This can be prevented by providing the pouring opening with a so-called pouring edge, that is to say an edge which guides the jet of contents away from the outside of the packing container. However, a pouring edge is difficult to combine with a cover strip, since the types of projecting pouring edges known up to now prevent the application of a plane cover strip over the pouring opening of the packing container. The pouring opening 4 in accordance with the invention is provided along a part of its periphery with a pouring edge 13, which delimits a countersunk area 9 located close to the pouring opening. The pouring edge 13 is bent outwardly and extends at an angle to the container wall, but since the pouring edge originates from the countersunk area 9 it will be nevertheless completely inside the plane which is defined by the outside of the packing laminate. In that way the pouring edge 13 does not hinder the application of the cover strip 5 or disturb the substantially plane shape of the same. This countersunk area 9 is constituted by a long and narrow recess extending along the edge line 7 of the pouring opening 4 which is located at one end of the pouring opening and extends in arc-shape along the same. As can be seen in FIG. 3, the recess has a substantially U-shaped cross-section and the pouring edge 13 is formed by one leg of the U. The pouring edge 13, as well as the countersunk area 9 is situated in the non-sealed area 8 between the sealing zone 6 and the pouring opening 4 and are not affected therefore by the tensile forces in the packing laminate, since these are absorbed by the cover strip 5. Nor is the pouring edge 13 affected by the pressure in the packing container 1 caused by the contents, since this pressure is equal on both sides of the pouring edge.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. An opening arrangement for a laminated packing container, comprising:

a laminated packing container wall having three layers of thermoplastic material and a pouring opening provided therethrough;

a cover strip sealed in a liquid-tight manner to an outer layer of said laminate, said cover strip having a non-sealed part for facilitating removal of said cover strip;

a sealing zone between said cover strip and said outer layer completely surrounding and being spaced from an edge of the pouring opening to avoid rupturing said edge upon opening said container, said sealing zone having a point directed toward said non-sealed part of said cover strip;

a countersunk area defining a pouring edge and comprising a long narrow recess extending along a portion of the pouring opening, said pouring edge being bent in an outwardly direction and extending at an angle to the container wall to guide said contents away from said laminate but remaining completely inside a plane defined by said outer layer of said laminate so as not to interfere with said cover strip; and the seal in the sealing zone between the cover strip and the outer layer being stronger than a bond between the outer thermoplastic layer and the central thermoplastic layer such that removal of said cover strip also delaminates said outer layer from said laminate, said delamination being initially concentrated at said point of said sealing zone.

* * * * *